US008562007B2

(12) United States Patent
Menichini

(10) Patent No.: US 8,562,007 B2
(45) Date of Patent: Oct. 22, 2013

(54) WALKER

(75) Inventor: Luigi Menichini, Foligno (IT)

(73) Assignee: Ormesa S.R.L., Foligno (IT)

( * ) Notice: Subject to any disclaimer, the term of this patent is extended or adjusted under 35 U.S.C. 154(b) by 211 days.

(21) Appl. No.: 12/736,870

(22) PCT Filed: May 22, 2009

(86) PCT No.: PCT/EP2009/056222
§ 371 (c)(1),
(2), (4) Date: Nov. 18, 2010

(87) PCT Pub. No.: WO2009/144172
PCT Pub. Date: Dec. 3, 2009

(65) Prior Publication Data

US 2011/0067740 A1 Mar. 24, 2011

(30) Foreign Application Priority Data

May 28, 2008 (IT) ..... MC20080019 U

(51) Int. Cl.
*A61H 3/00* (2006.01)

(52) U.S. Cl.
USPC ..... 280/87.05; 280/87.041; 135/67; 135/74

(58) Field of Classification Search
USPC ..... 280/87.021, 87.041, 87.05, 47.34, 280/47.41; 135/67, 74, 65; 5/86.1; 482/68, 482/69; 297/279, 5; 472/15
See application file for complete search history.

(56) References Cited

U.S. PATENT DOCUMENTS

| | | | | |
|---|---|---|---|---|
| 2,991,485 | A * | 7/1961 | Schulte | 5/87.1 |
| 3,165,314 | A * | 1/1965 | Clearman et al. | 482/68 |
| 3,596,298 | A * | 8/1971 | Durst, Jr. | 5/87.1 |
| 4,188,966 | A * | 2/1980 | Palmer et al. | 135/67 |
| 4,211,426 | A * | 7/1980 | Motloch | 280/87.041 |
| 4,359,242 | A | 11/1982 | Gerken et al. | 297/5 |
| 4,985,947 | A * | 1/1991 | Ethridge | 5/86.1 |
| 5,155,873 | A * | 10/1992 | Bridges | 4/667 |
| 5,255,697 | A * | 10/1993 | Grauer | 135/67 |
| 5,365,621 | A * | 11/1994 | Blain | 5/87.1 |
| 5,538,268 | A * | 7/1996 | Miller | 280/87.05 |
| 5,813,948 | A | 9/1998 | Quigg et al. | 482/67 |
| 6,343,802 | B1 * | 2/2002 | Workman et al. | 280/87.041 |
| 6,733,018 | B2 * | 5/2004 | Razon | 280/87.021 |
| 7,275,554 | B2 * | 10/2007 | Mullholand | 135/67 |
| 2001/0048206 | A1 * | 12/2001 | Niu et al. | 280/87.021 |

FOREIGN PATENT DOCUMENTS

| | | |
|---|---|---|
| AU | B-41124/96 | 6/1996 |
| DE | 88 03 607 | 6/1988 |
| FR | 2 773 989 | 7/1999 |
| GB | 2 189 219 | 10/1987 |
| JP | 2006-193240 | 7/2006 |

* cited by examiner

*Primary Examiner* — Katy M Ebner
*Assistant Examiner* — Emma K Frick
(74) *Attorney, Agent, or Firm* — Lowe Hauptman & Ham, LLP

(57) ABSTRACT

A walker (1) is disclosed, which comprises a base frame (20) supported by wheels (22) and support rods (3, 4) mounted on the said base frame (2) to support at a suitable height support means (7, 8) designed to support the patient during walking. The support rods (3, 4) are hinged mutually and to the base frame (2), in such a way to go from the operating position, in which the support means (7, 8) are at a suitable height to support the patient, to a minimum-volume position, in which the support means (7, 8) are near the baseframe (2).

18 Claims, 4 Drawing Sheets

WALKER

The present patent application relates to a walker.

As it is known, people unable to walk autonomously use a device designed to support them, which is normally defined as "walker". The walker allows the patient to keep his feet on the ground, in such a way to walk autonomously without the help of other people.

Moreover, the walker is an excellent device for the training and rehabilitation of patients who have suffered traumas to the lower limbs.

Generally, a walker comprising a cart mounted on swivelling wheels. Vertical rods are arranged on the cart to support means used to support the patient. The said support means can consist, for instance, in one or more belts that surround the patient's waist and/or a handlebar where the patient can place his hands.

Telescopic systems are known in order to adjust the support means to the correct height by making the vertical rods slide according to the height of is the patient.

However, such a type of walker according to the known technique is impaired by a great drawback caused by the excessive height determined by the presence of the vertical rods. This results in difficult transportation, handling and storage of the walker when it is not used by the patient.

The purpose of the present invention is to eliminate the inconveniences of the known technique, by devising a walker that takes a space with reduced height when it is not used by the patient.

Another purpose of the present invention is to devise a versatile, practical and easy-to-use walker.

These purposes are achieved according to the present invention with the features are claimed in the independent claim 1.

Advantageous embodiments of the invention are disclosed in the dependent claims.

The walker of the invention comprises a base frame supported by wheels and support rods mounted on the said base frame to support, at a suitable height, support means design to support the patient during walking.

The support rods are hinged mutually and to the base frame in such a way to go from the operating position, in which the support means are at a suitable height to support the patient, to a minimum volume position, in which the support means are near the base frame.

The advantages of the walker according to the present invention are clear. In fact, the system of hinged rods allows for closing the walker in minimum volume configuration to provide easy handling, transportation and storage. Moreover, said system of hinged rods allows for the fine adjustment of the support means in order to adjust the walker to patients with different height.

Additional characteristics of the invention will be clearer from the following detailed description, which refers to merely illustrative, not limiting embodiments, illustrated in the enclosed drawings, wherein.

Figure 1:
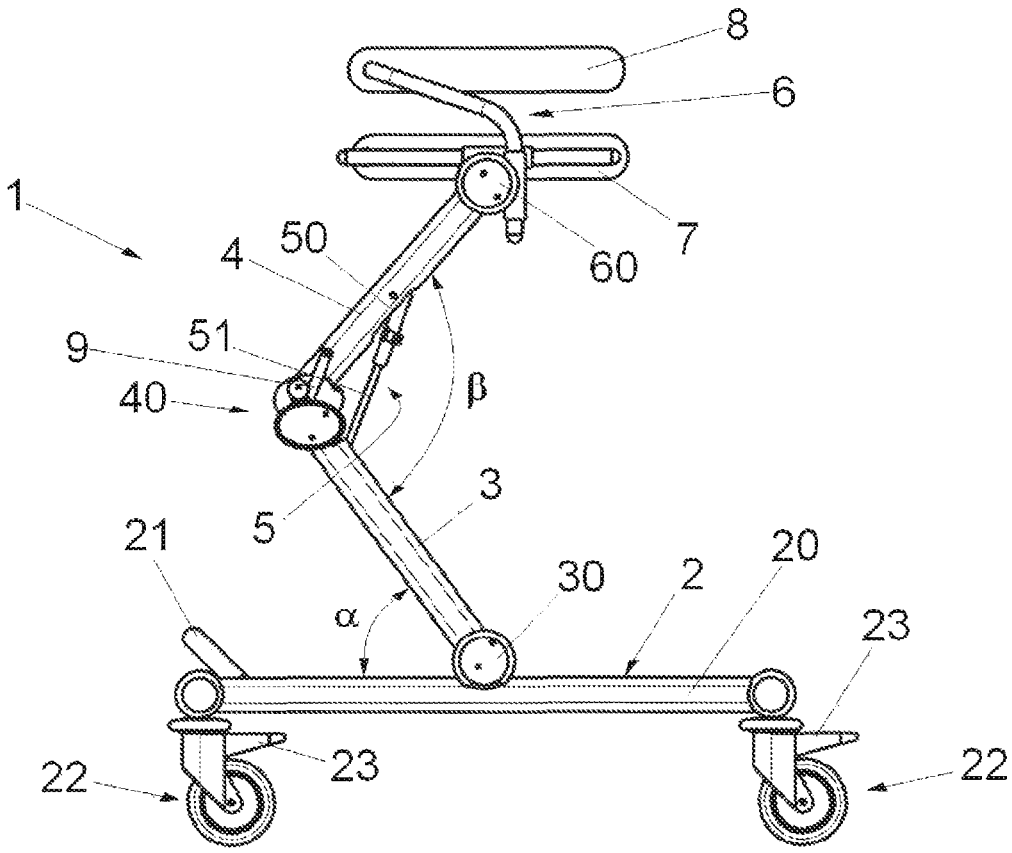
FIG. 1 is a side elevation view of a first embodiment of the push-walker according to the invention, shown in operating position.
Figure 2:
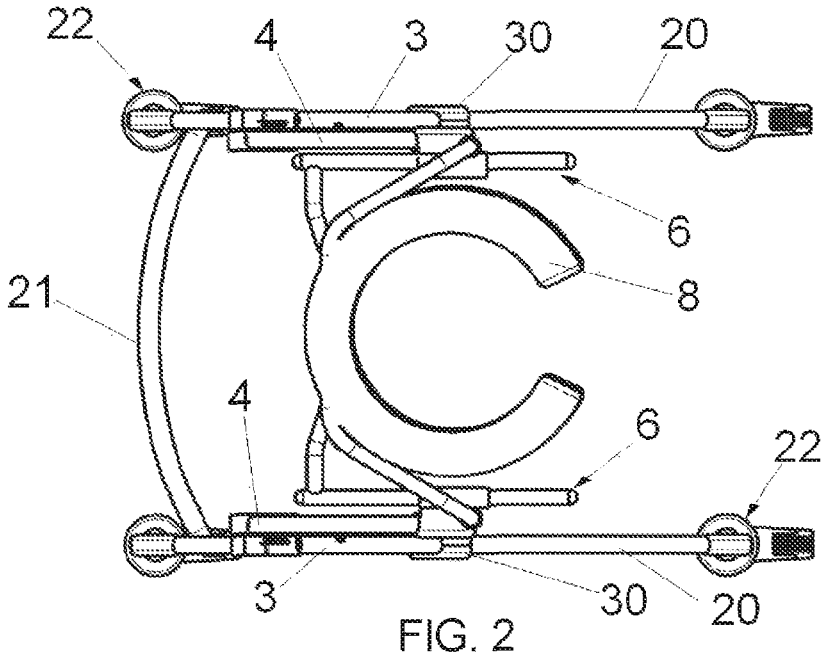
FIG. 2 is a top view of the walker of FIG. 1.

With reference to FIGS. 1-5, a first embodiment of the walker according to the present invention is disclosed, which is generally indicated with numeral (1).

The walker (1) comprises a base frame (2) with basically U-shape that extends on a horizontal plane. The base frame (2) is composed of two cross-pieces (20) connected by a slightly curved transversal rod (21).

Four swivelling wheels (22) with brakes (23) are mounted at the ends of the cross-pieces (20) of the base frame (2). The base frame (2) extends on a basically horizontal plane, when the wheels (22) rest on the ground.

The end of a first support rod (3) is hinged in the central part of each cross-piece (20) by means of a hinge (30). The hinge (30) is shaped as a cylindrical articulation with orthogonal axis to the axis of the cross-piece (20) and extends on a horizontal plane.

The first support rod (3) can rotate around the hinge (30) with respect to the cross-piece (20) by an angle ($\alpha$) that varies from 0° to 180°. Preferably, the hinge (30) is regulated in such a way that the angle ($\alpha$) varies from 0° to 80°. The first support rod (3) can go from a minimum volume position ($\alpha$=0°), which is basically parallel to the cross-piece (20) (FIG. 5), to a maximum height position ($\alpha$=80°), which is almost orthogonal to the cross-piece (20) (FIG. 1).

Figure 1A:
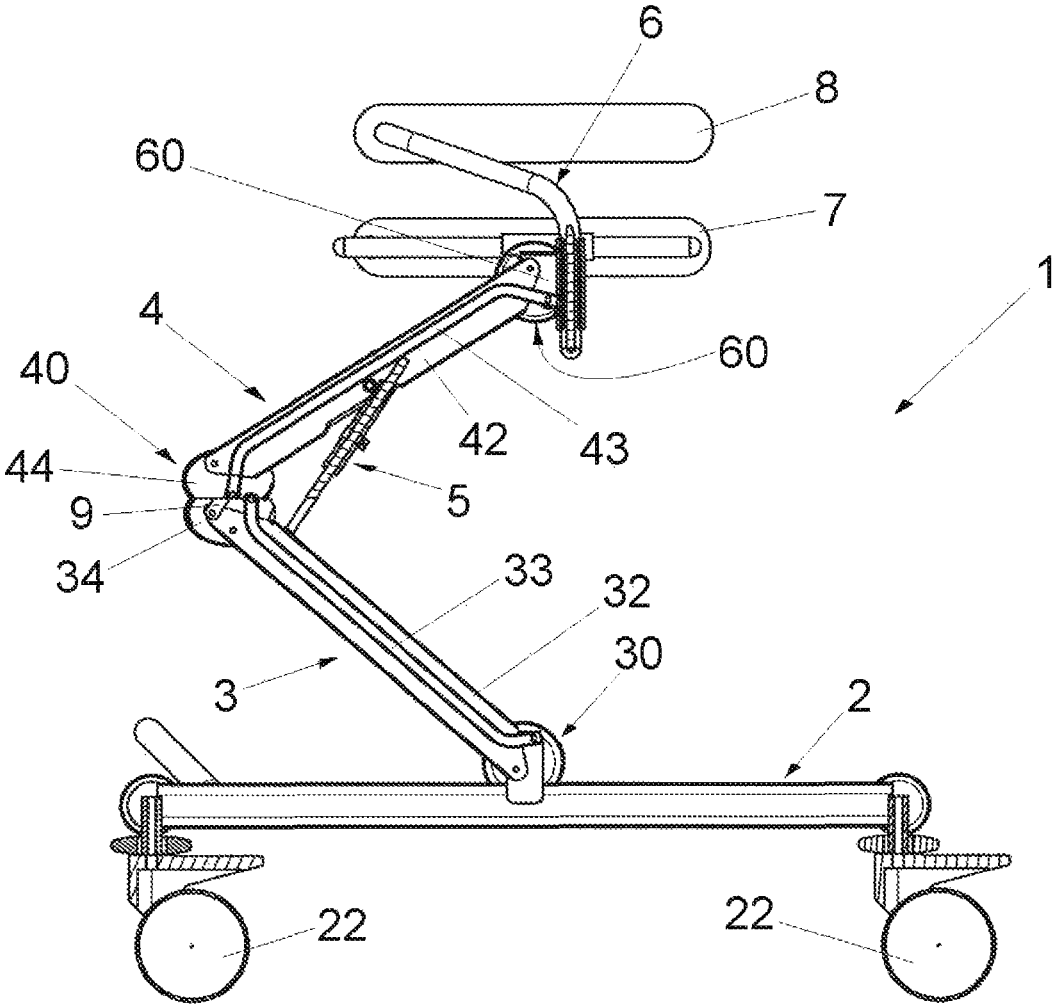
FIG. 1A is an axial sectional view of the walker of FIG. 1 in the axes of the lower and upper arms.
Figure 3:
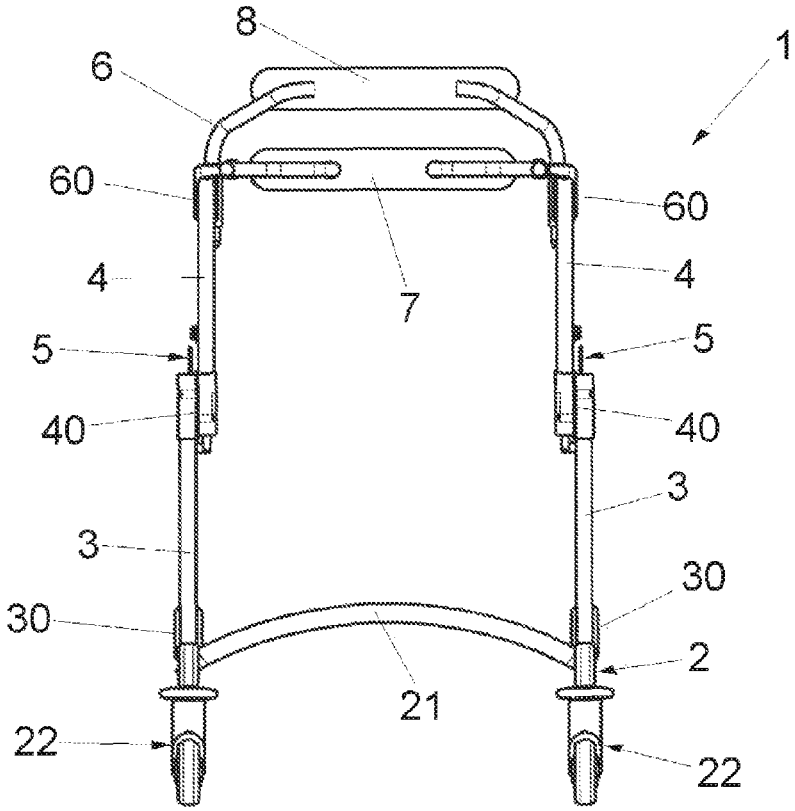
FIG. 3 is a rear view of the walker of FIG. 1.
Figure 4:
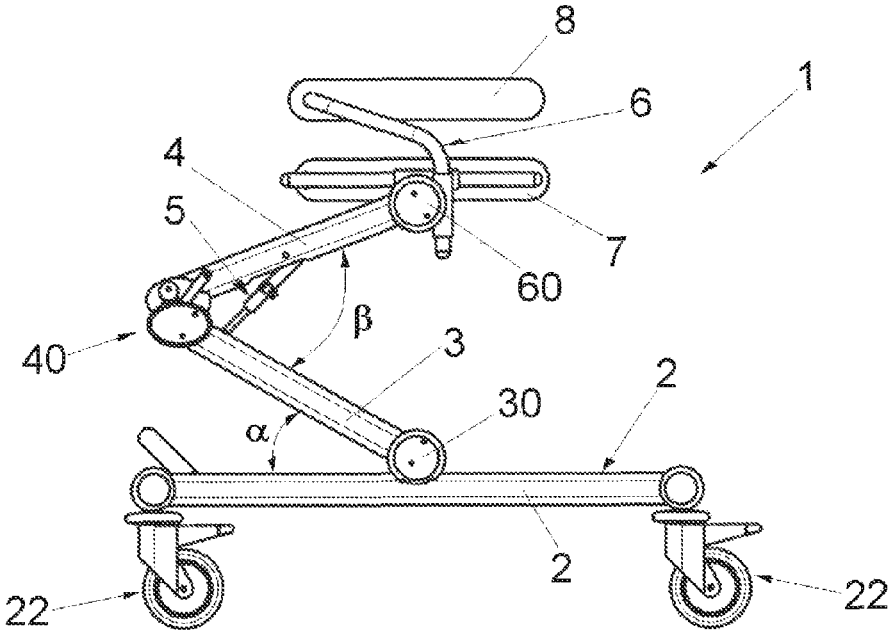
FIG. 4 is the same as FIG. 1, except in that it shows the walker in operating position at a lower height than FIG. 1.
Figure 5:
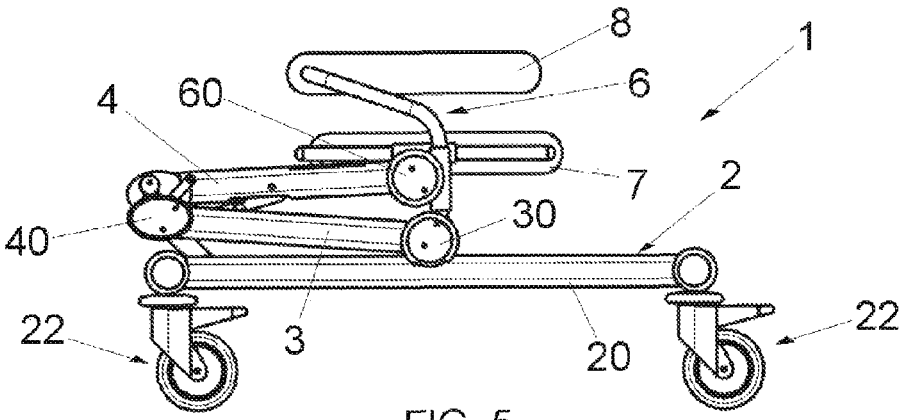
FIG. 5 is a view of the walker of FIG. 1 in minimum volume position.

A second support rod (4) is connected at the upper end of each of the first support rods (3) by means of a pantograph mechanism (40). As shown in FIG. 1A, the first rod (3) and the second rod (4) respectively comprise an external pipe (32, 42) and an internal pipe (33, 43) arranged inside the external pipe.

The internal pipes (33, 43) are connected to corresponding elliptical shells (34, 44) that act as joints. The external pipes (32, 42) are mutually connected by means of a connection rod (9) with the ends hinged to the external pipes.

Because of the pantograph mechanism (40), the first support rod (3) and the second support rod (4) can simultaneously rotate, generating the vertical movement of the upper end of the second rod (4). An angle ($\beta$) that can vary from 0° to 180° is generated between the two rods (3, 4). Preferably, the pantograph mechanism (40) is adjusted in such a way that the angle ($\alpha$) varies from 0° to 160°. The support rods (3, 4) can go from a minimum volume position ($\beta$=0°), in which the second rod (4) is almost overlapped to the first rod (3) (FIG. 5), to a maximum height position ($\beta$=160°), in which the second rod (4) is an extension of the first rod (3) (FIG. 1).

Stabilisation means (5) are provided between the two rods to stabilise the rotation of the second rod (4) with respect to the first rod (3). The stabilisation means (5) can comprise a cylinder—piston assembly, in which the cylinder (50) is hinged in a central portion of the second rod (4) and the piston (51) is hinged in the upper portion of the first rod (3).

The stabilisation means (5) also act as adjusting and lock means. To adjust the height of the walker and lock the two rods (3, 4) in position, the user can act on the cylinder-piston assembly (5).

An upper frame (6) is hinged with corresponding hinges (60) to the upper end of the two support rods (4). The upper frame (6) has a U-shape and acts as connection element of the two upper support rods (4). The upper frame (6) is provided with two padded rings (7, 8) that can be opened and locked, which are shaped as a C in the plan (FIG. 2) and designed to surround the patient's waist. The walker (1) shown in FIGS. 1-5 is a back push walker, because it is dragged by the patient.

Preferably, each upper hinge (60) must be positioned in a vertical axis passing through the corresponding lower hinge (30). The pantograph mechanism (40) ensures that the upper hinge (60) is positioned on the same vertical axis as the lower hinge (30) and makes a vertical movement.

The lower support rods (3) and the upper support rods (4) form a pantograph or knee or compass mechanism and can be easily adjusted in a maximum height position (FIG. 1), in a plurality of intermediate height positions (FIG. 4) and in a minimum volume position (FIG. 5) for easy handling, transport and storage.

Figure 6:
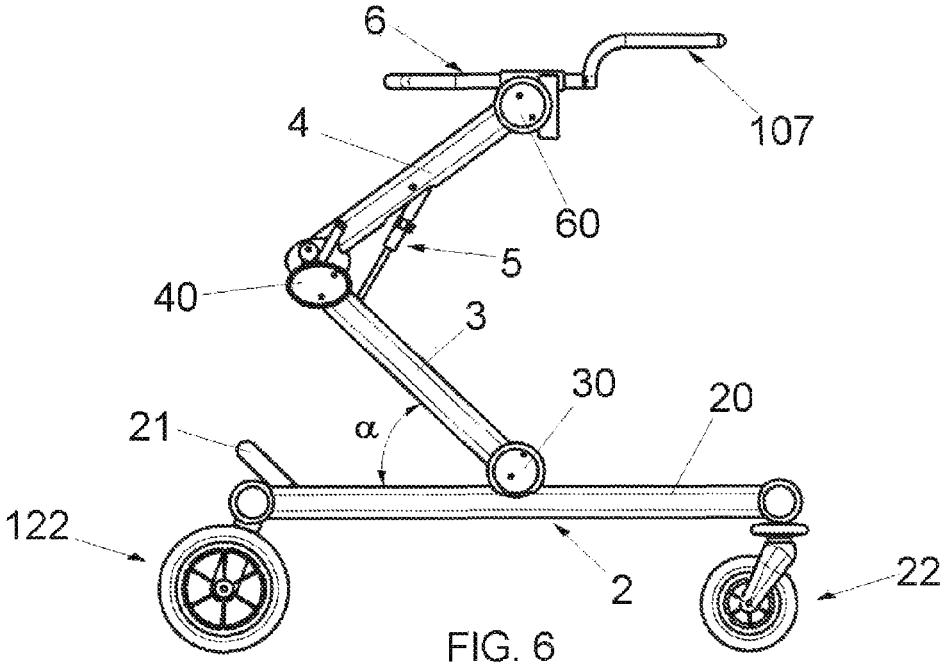
FIG. 6 is a side view of a second embodiment of a pull-walker according to the present invention.
Figure 7:
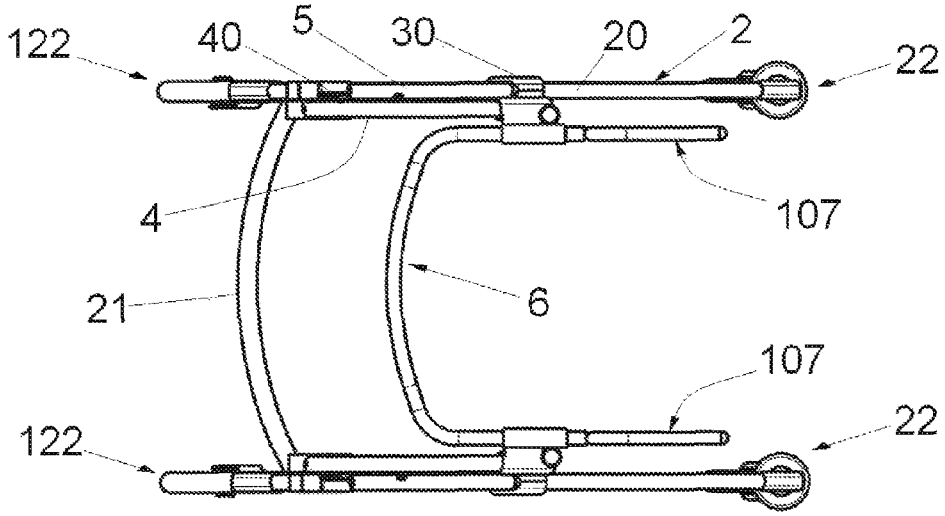
FIG. 7 is a top view of the walker of FIG. 6.

FIGS. 6 and 7 illustrate a pull-walker (100) according to a second embodiment of the invention, in which the same elements as the ones illustrated above are indicated with the same reference numerals, omitting the detailed description.

The walker (100) differs from the walker (1) of the first embodiment only in the fact that, instead of being provided with padded rings, the upper frame (6) that connects the two upper rods (4) is provided with a handlebar (107) designed to be grabbed by the patient to pull the walker. In fact, the walker (100) is a pull-walker.

In this case the two front wheels (122) of the walker have a larger diameter than the back wheels (22) and are not swivelling wheels.

Numerous variations and modifications can be made to the present embodiments of the invention by an expert of the field, while still falling within the scope of the invention as claimed in the enclosed claims.

The invention claimed is:

1. A walker (1; 100) comprising a base frame (20) supported by wheels (22; 122) and support rods (3; 4) mounted on the said base frame (2) to support, at suitable height, support means (7; 8; 107) designed to support the patient while walking, wherein the support rods (3; 4) are hinged mutually and to the base frame (2), in such a way to go from an operating position, in which the support means (7; 8; 107) are at a suitable height to support the patient, to a minimum volume position, in which the support means (7; 8; 107) are near the base frame (2), wherein the support rods comprise at least a lower rod hinged by means of a hinge to the base frame and at least an upper rod hinged by means of a pantograph mechanism to the lower rod, wherein the rods (3; 4) respectively comprise an external pipe (32; 42) inside of which an internal pipe (33; 43) is extended, in which the ends of the internal pipes (33; 43) are connected to corresponding elliptical shells (34; 44) and the external pipes (32; 42) are connected mutually by a connection rod (9) to form the pantograph mechanism (40).

2. The walker (1; 100) as claimed in claim 1, wherein the hinge (30) comprises adjusting and lock means to adjust the inclination angle (.alpha.) (a) between the frame (2) and the lower rod (3).

3. The walker (1; 100) as claimed in claim 1, wherein the walker comprises lock means (5) between the lower rod (3) and the upper rod (4) to lock the two rods in position.

4. The walker (1; 100) as claimed in claim 3, wherein the lock means (5) comprise an assembly composed of a cylinder (50) and a piston (51).

5. The walker (1; 100) as claimed in claim 4, wherein an upper frame (6) is hinged at the upper end of the two upper rods (4), being provided with support means (7; 8; 107).

6. The walker (1; 100) as claimed in claim 1, wherein the base frame (2) is U-shaped and comprises two cross-pieces (20) connected by a transversal rod (21) and in that in the central part of the cross-pieces (20) corresponding lower rods (3) are hinged, which are in turn hinged to corresponding upper rods (4).

7. The walker (1; 100) as claimed in claim 6, wherein the upper frame (6) is U-shaped.

8. The walker (1) as claimed in claim 1, wherein the walker is a push walker and the support means (6, 7) comprise at least one openable padded ring designed to surround the patient's waist.

9. The walker (100) as claimed in claim 1, wherein the walker is a pull walker and the support means (107) comprise a handlebar designed to be grabbed by the patient.

10. A walker comprising:

a base frame having wheels;

a pair of lower rods each hingedly connected to the base frame;

a pair of upper rods each hingedly connected to one of the pair of lower roads, the upper rods being hingedly connected to the lower rods by a pantograph mechanism; and an upper frame hingedly connected to pair of upper rods, the upper frame being height adjustable and having an operating position for supporting a patient and a minimum volume position, wherein each of the pair of lower rods respectively comprise an external pipe inside of which an internal pipe is extended, in which the ends of the internal pipes are connected to corresponding elliptical shells and the external pipes are connected mutually by a connection rod to form the pantograph mechanism.

11. The walker as claimed in claim 10, wherein the base frame comprises:

at least two cross-pieces connected by a transversal rod; and each of the pair of lower rods are hingedly connected to a corresponding one of the at least two cross-pieces.

12. The walker as claimed in claim 11, wherein each of the pair of lower rods are connected to a central portion of the corresponding cross-piece.

13. The walker as claimed in claim 10, further comprising:

a pair of assemblies each comprising:

a cylinder; and a piston coupled with the cylinder, wherein each assembly of the pair of assemblies is connected between one hingedly connected upper rod and lower rod.

14. The walker as claimed in claim 10, wherein the hinged connection of one hingedly connected upper rod and the upper frame is positioned in a vertical axis with the hinged connection of a corresponding one hingedly connected lower rod and the base frame.

15. The walker as claimed in claim 10, wherein the hinged connection of a lower rod to the base frame is vertically aligned with the hinged connection of an upper rod to the support frame.

16. The walker as claimed in claim 10, wherein the upper frame is U-shaped.

17. The walker as claimed in claim 10, wherein the upper frame comprises at least one padded ring.

18. The walker as claimed in claim 10, wherein the upper frame comprises a handlebar.

* * * * *